US006666146B2

(12) United States Patent
Wardecki et al.

(10) Patent No.: US 6,666,146 B2
(45) Date of Patent: Dec. 23, 2003

(54) PROJECTILE

(75) Inventors: Norbert Wardecki, Heuweiler (DE); Achim Lais, Kandern (DE); Andreas Blache, Lörrach (DE); Ralf Gregorzik, Freiburg (DE)

(73) Assignee: Buck Neue Technologien GmbH, Neuenburg (DE)

( * ) Notice: Subject to any disclaimer, the term of this patent is extended or adjusted under 35 U.S.C. 154(b) by 0 days.

(21) Appl. No.: 10/050,324

(22) Filed: Jan. 16, 2002

(65) Prior Publication Data

US 2003/0131752 A1 Jul. 17, 2003

(30) Foreign Application Priority Data

Feb. 9, 2001 (DE) ..... 101 05 867

(51) Int. Cl.[7] ..... F42B 12/58
(52) U.S. Cl. ..... 102/489; 102/357; 102/393
(58) Field of Search ..... 102/489, 393, 102/340, 342, 351, 357

(56) References Cited

U.S. PATENT DOCUMENTS

| | | | | |
|---|---|---|---|---|
| 1,366,555 A | * | 1/1921 | Brayton | |
| 3,760,729 A | * | 9/1973 | Freeman | |
| 4,186,664 A | | 2/1980 | Huber et al. | |
| 4,869,174 A | | 9/1989 | Hanser et al. | |
| H699 H | * | 11/1989 | Thomas, Sr. | 102/370 |
| 6,138,951 A | * | 10/2000 | Budris et al. | 102/393 |

FOREIGN PATENT DOCUMENTS

| | | | | |
|---|---|---|---|---|
| DE | 740 228 | * | 10/1943 | 102/393 |
| DE | 75 18 303 | | 6/1975 | |
| DE | 24 37 535 | * | 2/1976 | 102/489 |
| DE | 25 55 323 | | 5/1979 | |
| DE | 31 04 464 A1 | | 8/1982 | |
| DE | 2841815 C2 | | 2/1985 | |
| DE | 197 19 701 C2 | | 11/1998 | |
| DE | 197 53 661 C1 | | 6/1999 | |
| GB | 1 415 274 | | 11/1975 | |
| GB | 1 510 986 | | 5/1978 | |
| GB | 1 537 691 | | 1/1979 | |
| JP | 2-10099 | * | 2/1990 | |

* cited by examiner

*Primary Examiner*—Stephen M. Johnson
(74) *Attorney, Agent, or Firm*—Burns, Doane, Swecker & Mathis, LLP

(57) ABSTRACT

The present invention relates to a projectile including a projectile charge consisting of a plurality of submunitions (2*b*), arranged in a shell jacket, of metal bodies (3) which contain at least one pyrotechnical active mass (10) and at least one igniter charge (12), wherein the submunitions (2*b*) are arranged around a tube (4), the lumen (5) of which forms a passage in the direction of the projectile's longitudinal axis (6), an ejector charge for ejecting the submunitions (2*b*) following launch of the projectile after reaching the target area, the tube (4) including throttle bores (11) directly communicating with the igniter charges (12) of the respective submunitions (2*b*).

12 Claims, 1 Drawing Sheet

PROJECTILE

BACKGROUND

1. Field of the Invention

The present invention relates to a projectile.

2. Background Information

Projectiles, in particular smoke projectiles, of various calibers have a construction wherein a plurality of submunitions are carried along in the projectile shells. Following discharge of the ammunition and upon reaching the target area, an ejector charge is fired in the nose of the projectile, the so-called ogive, to push the entire internal structure out of the projectile shell on the one hand, and via pyrotechnical delay elements ignites the gas pressure-sensitive active masses in the submunitions on the other hand.

Such projectiles are described, e.g., in DE 28 41 815 C2.

In this prior art the submunitions comprise a central through bore which forms the passage after assembly of the projectile with the other submunitions. The pressure building up upon ignition of the ejector charge propagates through the passage and there ignites the pyrotechnical delay elements installed in the single submunitions. Via this ignition train consisting of ejector charge—pyrotechnical delay element—igniter charge, the pyrotechnical active mass, for example a smoke active mass, in the submunitions is initiated. Here the delay elements, apart from ignition transmission, mainly have the task of shielding the high pressure of the hot gases originating from the ejector charge and building up pressures of up to 370 bar which prevails in the passage, from active mass which is sensitive to gas pressure. Application of this pressure to the active mass would lead to an explosive reaction of the highly energetic active mass at an inappropriate point of time or, on the other hand, as early as inside the launcher tube.

In the existing solutions of the prior art, pyrotechnical delay elements are required as a general rule. These pyrotechnical delay elements present several drawbacks:

Due to the high rotational stress of the projectiles in the order of about 18,000 rpm, liquefaction of the pyrotechnical charge of the delay elements takes place, resulting in functionality not being guaranteed at a hundred percent, for which reason the like delay elements in projectiles constitute a quite considerable risk factor when used in an ammunition. To ensure redundancy safety upon ignition of the active mass, at least two delay elements per submunition thus have to be used. This does, however, increase the costs to such an extent that in the case of high numbers of rounds of ammunition, the use of delay elements constitutes a factor which cannot be left out of consideration.

Further drawbacks in terms of construction result, e.g. owing to the required reception thread and the additional space demand of two delay elements.

In addition, the igniting energy of pyrotechnical delay elements, which derives from pressure and number of the hot particles, is comparatively low and only directed at a small, limited area in front of the exit of the delay element.

SUMMARY

Starting out from this prior art, it was therefore the object of the present invention to furnish improved projectiles while doing away with pyrotechnical delay elements, which are nevertheless safe upon handling and triggering.

In accordance with the invention, its subject matter is a projectile including a projectile charge consisting of a plurality of submunitions of metal bodies arranged inside a shell jacket, containing at least one pyrotechnical active mass and at least one igniter charge, wherein the submunitions are arranged around a tube, the lumen of which forms a passage in the direction of the projectile's longitudinal axis;

an ejector charge for ejecting the submunitions following launch of the projectile upon reaching the target area, the tube including throttle apertures directly communicating with the igniter charges of the respective submunitions.

Due to the fact that the tube presents throttle apertures directly communicating with the igniter charges of the respective submunitions, it is possible to do away with the use of pyrotechnical delay elements because ignition is effected directly over the entire surface of the igniter charge through the ejector charge at concurrent pressure throttling, whereby high ignition security is provided.

Owing to pressure throttling, the hazardous instantaneous reaction of the highly energetic active mass at an inappropriate point of time is also avoided.

In the projectile according to the invention, ignition of the active mass thus takes place through a controlled pressure-type ignition of an ignition-sensitive igniter charge covering the surface of the active mass.

As the ignition pulse, the gas pressure of the ejector charge and the hot particles of the ejector charge are employed. The high gas pressure of up to 300 bar that prevails in the passage formed by the tube, is strongly reduced by means of the throttle bore. This reduced pressure distributes in the entire available space and thus over the entire surface of the igniter charge to fire the latter.

This means that the size of the throttle bore must be adapted to the ignition threshold of the active mass to be ignited and to its threshold for instantaneous reaction.

The principle of solution of the present invention thus consists of one or several aperture(s) between the passage (tube) and the otherwise encapsulated active mass surface, bringing about a defined reduction of the gas pressure prevailing in the passage. In the projectile of the invention, the following advantages are moreover achieved:

the ignition train is reduced by at least one component;

the entire projectile structure is simplified to ensure higher functional safety;

no costs are incurred for pyrotechnical delay elements;

the space demand for delay elements is avoided;

more reliable ignition due to the pressure acting on the entire surface of the igniter charge.

The present invention acquires a particular importance in the case of a smoke projectile having as the pyrotechnical active mass a smoke active mass which is known per se.

Due to the fact that the projectile's longitudinal axis and the tube's center axis coincide, there accordingly results a concentric arrangement of the submunitions around the tube, and thus a symmetrical projectile structure.

It was found to be advantageous to produce the throttle apertures by means of throttle bores, however star-shaped or cross-shaped apertures are nevertheless also conceivable as throttle apertures.

It was found in practice that the diameters of the throttle bores are selected such that following ignition of the ejector charge on the side of the throttle bores facing away from the passage, a pressure of approx. 20–150 bar, preferably of approx. 60–70 bar, in particular of approx. 65 bar prevails.

For smoke projectiles of caliber 155 mm, for example, the passage has a diameter of approx. 5–20 mm, and the throttle bore has a diameter of approx. 1–4 mm.

BRIEF DESCRIPTION OF THE DRAWINGS

Further advantages and features of the present invention result from the description of an embodiment by referring to the drawing, wherein.

DETAILED DESCRIPTION OF THE PREFERRED EMBODIMENTS

Figure 1:
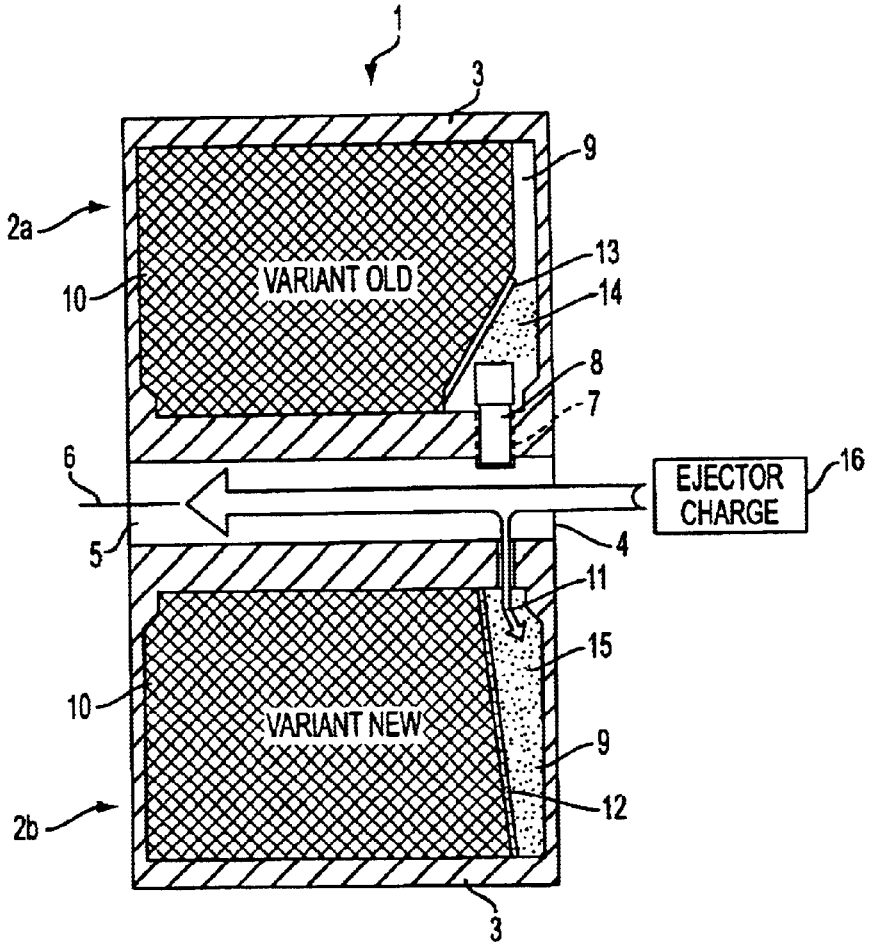
FIG. 1 shows a longitudinal sectional view of a smoke active mass submunition of a smoke projectile.

In FIG. 1, there is shown under 1 a detail from a schematic longitudinal sectional view of a smoke projectile, showing a submunition 2*a* in the upper range of FIG. 1 and a submunition 2*b* in the lower range of FIG. 1 to facilitate comprehension of the present invention. The submunitions in the exemplary smoke projectile are formed of metal bodies 3. The submunitions are arranged around a tube 4, the lumen 5 of which forms a passage in the direction of the projectile's longitudinal axis 6.

The submunition 2*a* in accordance with the prior art includes in a bore 7 a pyrotechnical delay element 8 which protrudes into the interior 9 of the submunition 2*a*. The submunition 2*a* contains within the metal body 3 a smoke active mass 10.

In contrast, the projectile of the invention is equipped with submunitions 2*b* having the following structure:

The submunition 2*b* contains inside the metal body 3 the smoke active mass 10. Instead of the delay element 8 in the submunition 2*a*, the variant of the invention includes a throttle bore 11 extending from the lumen 5 of the tube 4 and communicating with the inside 9 of the submunition 2*b*.

In the exemplary case, the internal diameter of the tube 4 is approx. 14 mm, and the diameter of the throttle bore is about 2.0 mm.

An igniter charge 12 is arranged in the submunition 2*b* across the entire side of the smoke active mass 10 facing the inner space 9 of the submunition 2*b*.

The following is a description of the functional principle of the submunition 2*a* shown in FIG. 1 (former variant) in accordance with the prior art, and of a projectile according to the invention which includes a submunition 2*b* (new variant), wherein FIG. 1 represents the prior art and the invention in one and the same projectile assembly merely for reasons of clarity, which is, however, not the case in reality.

In the submunition 2*a* in accordance with the prior art, the following processes unfold:

After ejection of the projectile from a launcher, an ejector charge is ignited at the appropriate time, which ejects the submunitions and ignites them. Upon ignition of the ejector charge 16 a pressure of approx. 370 bar and a temperature of approx. 500° C. are created. The hot gases flowing through the lumen 5 of the tube 4 in the direction of the arrow in FIG. 1 ignite the pyrotechnical delay element 8 lodged in the bore 7 of the submunition 2*a*. Following burn-off of the pyrotechnical delay element, an igniter charge shown under 13 in FIG. 1 is ignited, with the igniter charge 13 in turn igniting the active mass 10 to thereby generate the smoke.

The embodiment of the projectile in accordance with the prior art 2*a* results—should the delay element 8 indeed ignite—in few hot particles 14 and low pressure.

Failures are thus possible, for only few hot particles 14 are generated, of whose number and energy initiation of the igniter charge 13 depends.

In contrast, in the embodiment of the invention, the submunition of which is designated by 2*b* in FIG. 1, a pressure reduction of the gas pressure of the ejector charge of approx. 350 bar via the throttle bore 11 to the inside 9 of the submunition 2*b* to a reduced pressure of approx. 50 bar takes place, whereby the hot particles 15 are present with a homogeneous distribution in the entire inner range 9.

This multiplicity of hot particles 15 then ignite the igniter charge 12 which is distributed over the entire area of the smoke active mass 10 and in turn ignites the smoke active mass 10.

The projectile of the invention therefore is far more reliable and cost-effective than the prior-art projectiles.

What is claimed is:

1. A projectile including a projectile charge comprising:

a plurality of submunitions, arranged in a shell jacket, of metal bodies which contain at least one pyrotechnical active mass and at least one igniter charge, wherein said submunitions are arranged around a tube, the lumen of which forms a passage in a direction of a longitudinal axis of the projectile; and an ejector charge for ejecting said submunitions following a launch of the projectile and upon reaching a target area, wherein said tube includes throttle apertures directly communicating with said igniter charge, and wherein said throttle apertures are throttle bores, wherein diameters of said throttle bores are selected such that following ignition of said ejector charge, on a side of the throttle bores facing away from said passage, a pressure of approx. 20–150 bar prevails.

2. A projectile in accordance with claim 1, wherein the projectile is a smoke projectile, said pyrotechnical active mass being a smoke active mass.

3. A projectile in accordance with claim 1, wherein the longitudinal axis of the projectile and a center axis of said tube coincide.

4. A projectile including a projectile charge comprising:

a plurality of submunitions, arranged in a shell jacket, of metal bodies which contain at least one pyrotechnical active mass and at least one igniter charge, wherein said submunitions are arranged around a tube, the lumen of which forms a passage in a direction of a longitudinal axis of the projectile; and an ejector charge for ejecting said submunitions following a launch of the projectile and upon reaching a target area, wherein said tube includes throttle apertures directly communicating with said igniter charge, and wherein said projectile is a smoke projectile, said passage has a diameter of approx. 5–20 mm, and said throttle bores have a diameter of approx. 1–4 mm.

5. A projectile in accordance with claim 4, wherein the projectile is a smoke projectile, said pyrotechnical active mass being a smoke active mass.

6. A projectile in accordance with claim 4, wherein the longitudinal axis of the projectile and a center axis of said tube coincide.

7. A projectile including a projectile charge comprising:

a plurality of submunitions, arranged in a shell jacket, of metal bodies which contain at least one pyrotechnical active mass and at least one igniter charge, wherein said submunitions are arranged around a tube, the lumen of which forms a passage in a direction of a longitudinal axis of the projectile; and an ejector charge for ejecting said submunitions following a launch of the projectile and upon reaching a target area, wherein said tube includes throttle apertures directly communicating with said igniter charge, wherein said throttle apertures are throttle bores, and wherein diameters of said throttle bores are selected such that following ignition of said ejector charge, on a side of the throttle bores facing away from said passage, a pressure of approx. 60–70 bar prevails.

8. A projectile in accordance with claim 7, wherein the projectile is a smoke projectile, said pyrotechnical active mass being a smoke active mass.

9. A projectile in accordance with claim 7, wherein the longitudinal axis of the projectile and a center axis of said tube coincide.

10. A projectile including a projectile charge comprising:

a plurality of submunitions, arranged in a shell jacket, of metal bodies which contain at least one pyrotechnical active mass and at least one igniter charge, wherein said submunitions are arranged around a tube, the lumen of which forms a passage in a direction of a longitudinal axis of the projectile; and an ejector charge for ejecting said submunitions following a launch of the projectile and upon reaching a target area, wherein said tube includes throttle apertures directly communicating with said igniter charge, wherein said throttle apertures are throttle bores, and wherein diameters of said throttle bores are selected such that following ignition of said ejector charge, on a side of the throttle bores facing away from said passage, a pressure of approx. 65 bar prevails.

11. A projectile in accordance with claim 10, wherein the projectile is a smoke projectile, said pyrotechnical active mass being a smoke active mass.

12. A projectile in accordance with claim 10, wherein the longitudinal axis of the projectile and a center axis of said tube coincide.

* * * * *